US005099220A

United States Patent [19]

Camarota

[11] Patent Number: 5,099,220

[45] Date of Patent: Mar. 24, 1992

[54] WATERPROOF FLUSH MOUNT MARINE HORN ASSEMBLY

[75] Inventor: Richard J. Camarota, Holland, Mich.

[73] Assignee: ITC Incorporated, Zeeland, Mich.

[21] Appl. No.: 550,799

[22] Filed: Jul. 10, 1990

Related U.S. Application Data

[63] Continuation of Ser. No. 385,588, Jul. 25, 1989, abandoned.

[51] Int. Cl.[5] ..... G08B 3/00

[52] U.S. Cl. ..... 340/388; 116/26; 116/137 R; 340/404; 340/405; 340/406; 340/984

[58] Field of Search ..... 340/387, 388, 404–406, 340/984, 985; 116/26, 108, 142 R, 137 R

[56] References Cited

U.S. PATENT DOCUMENTS

| | | | |
|---|---|---|---|
| 1,698,804 | 1/1929 | Sparks et al. . | |
| 1,874,078 | 8/1932 | Aufiero . | |
| 2,166,821 | 7/1939 | Nielsen . | |
| 2,689,543 | 9/1954 | Lemmon . | |
| 3,124,098 | 3/1964 | Thoben . | |
| 3,906,490 | 9/1975 | Shaw . | |
| 4,079,364 | 3/1978 | Antenore | 340/603 |
| 4,281,224 | 7/1981 | Castagna . | |
| 4,625,829 | 12/1986 | Sirois . | |
| 4,710,749 | 12/1987 | Berke et al. . | |
| 4,825,800 | 5/1989 | Kitchen . | |

FOREIGN PATENT DOCUMENTS

| | | | |
|---|---|---|---|
| 0079494 | 7/1978 | Japan | 340/387 |

*Primary Examiner*—Jin F. Ng
*Assistant Examiner*—Brent A. Swarthout
*Attorney, Agent, or Firm*—Flynn, Thiel, Boutell & Tanis

[57] ABSTRACT

A waterproof flush-mountable marine horn assembly includes a generally cup-shaped housing having a bottom wall and upstanding side wall means. The side wall means includes a top edge portion which defines a top rim of the housing, which top rim defines thereinside an opening in said housing. A flange extends from the top rim in a direction substantially opposite the housing opening and has a top surface facing away from the bottom wall and surrounding the opening. A horn is disposed within and secured to the housing. A waterproof membrane is stretched across the housing opening and secured to the top surface of the flange so as to completely cover the housing opening.

11 Claims, 5 Drawing Sheets

WATERPROOF FLUSH MOUNT MARINE HORN ASSEMBLY

This application is a continuation-in-part of U.S. Ser. No. 07/385,588, filed July 25, 1989 and now abandoned.

FIELD OF THE INVENTION

This invention relates generally to a horn assembly for marine use and, more particularly, to a marine horn assembly which is waterproof and can be mounted on a watercraft hull so as to be substantially flush with a selected surface thereof.

BACKGROUND OF THE INVENTION

Marine horns have long been used as signaling devices on watercraft, and are generally considered to be indispensable to safe water travel. Many, if not all, states have safety regulations which require horns as a safety precaution on all water craft of any significant size.

The nature of water travel, and the weather conditions to which many watercraft are exposed make a waterproof marine horn assembly desirable. More specifically, and particularly with regard to pleasure craft, many areas of a watercraft are subjected to water as a matter of course in everyday use. Swimming, skiing and fishing are examples of recreational activities commonly associated with the use of pleasure craft which often result in water being carried into even the most remote recesses of such pleasure craft. Exposure to water can damage a marine horn, and exposure to salt water can be particularly destructive. Further, pleasure craft are often exposed to the elements continuously during the warm weather months when they are being used most frequently. Thus, the effect of rain water on the craft must also be considered. Further, routine washing of a watercraft can introduce unwanted water into a horn assembly. Accordingly, regardless of where a marine horn assembly is mounted on a watercraft, it may be exposed to water, and it is therefore desirable that it be waterproof.

Because marine horn assemblies are often mounted on the outer surfaces of the hull of the watercraft, a marine horn assembly which can be mounted flush with the hull is desirable. More specifically, marine horn assemblies are often mounted on a deck or an outer surface of the bow of a watercraft. If such horns are not flush mount units, those mounted on the deck can be a stumbling hazard, and those mounted on the bow can be easily damaged, for example, when attempting to dock the craft. It is therefore desirable to provide a marine horn assembly which can be mounted substantially flush with the hull surface.

Accordingly, it is an object of the present invention to provide a waterproof marine horn assembly for use on a watercraft.

It is a further object of the present invention to provide a marine horn assembly, as aforesaid, which is adapted for mounting substantially flush with the surface of a watercraft hull.

It is a further object of the present invention to provide a marine horn assembly, as aforesaid, which is easily installed as a single unit in an opening formed in a watercraft hull.

It is a further object of the present invention to provide a marine horn assembly, as aforesaid, which can be installed in a watercraft hull in any desired orientation.

It is a further object of the invention to provide a marine horn assembly, as aforesaid, which is simple and inexpensive to manufacture and which is easily maintainable.

It is a further object of the invention to provide a marine horn assembly, as aforesaid, which has an aesthetically pleasing appearance.

SUMMARY OF THE INVENTION

The objects and purposes of the invention, including those set forth above, are met by providing a generally cup-shaped housing having an opening. A horn is disposed within the housing. A substantially acoustically transparent, waterproof membrane covers the housing opening against water entry into the housing.

BRIEF DESCRIPTION OF THE DRAWINGS

An exemplary embodiment of the invention will be described in detail hereinafter in connection with the drawings, in which.

DETAILED DESCRIPTION

Figure 1:
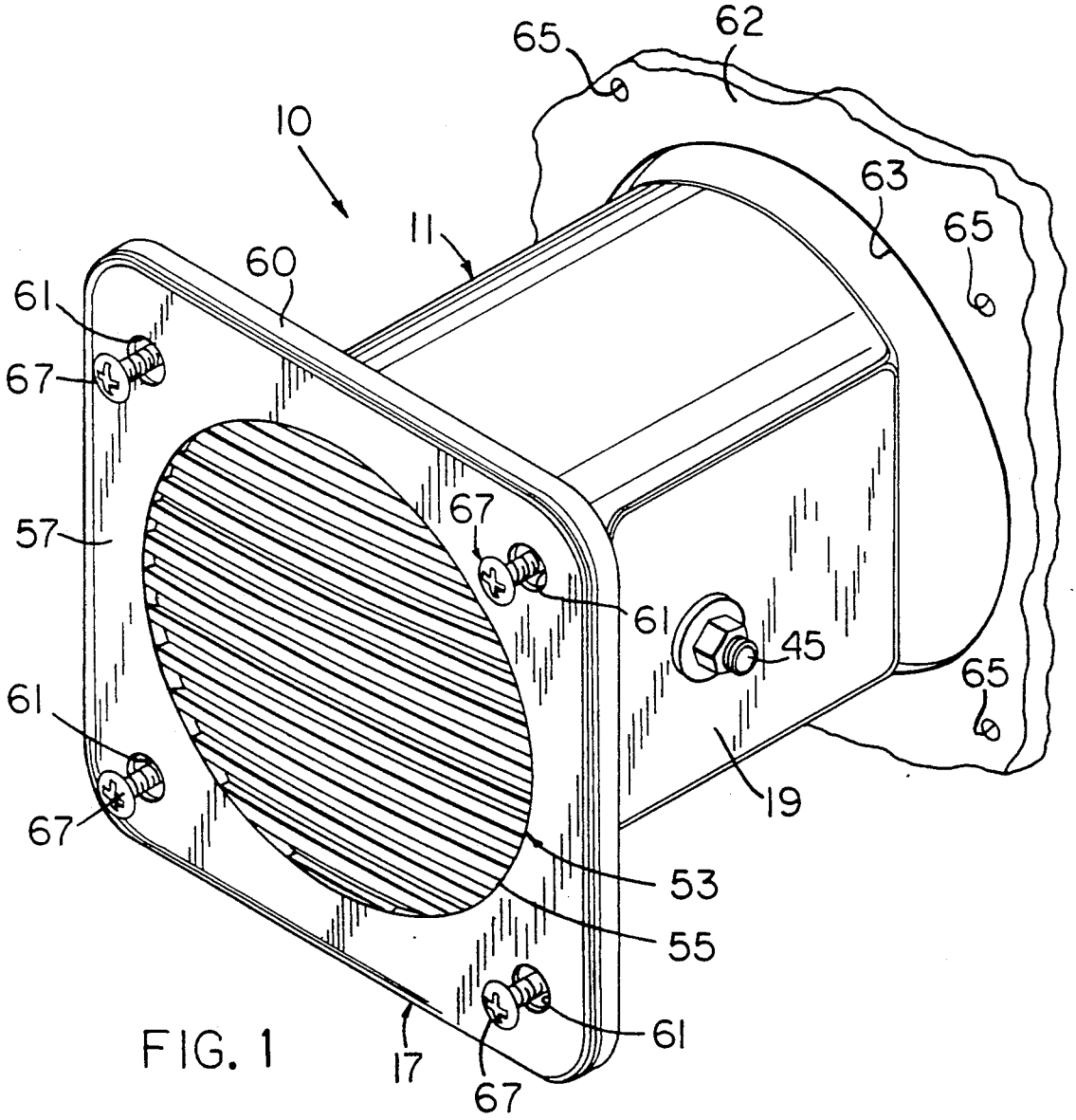
FIG. 1 is a pictorial view of a marine horn assembly embodying the invention.
Figure 2:
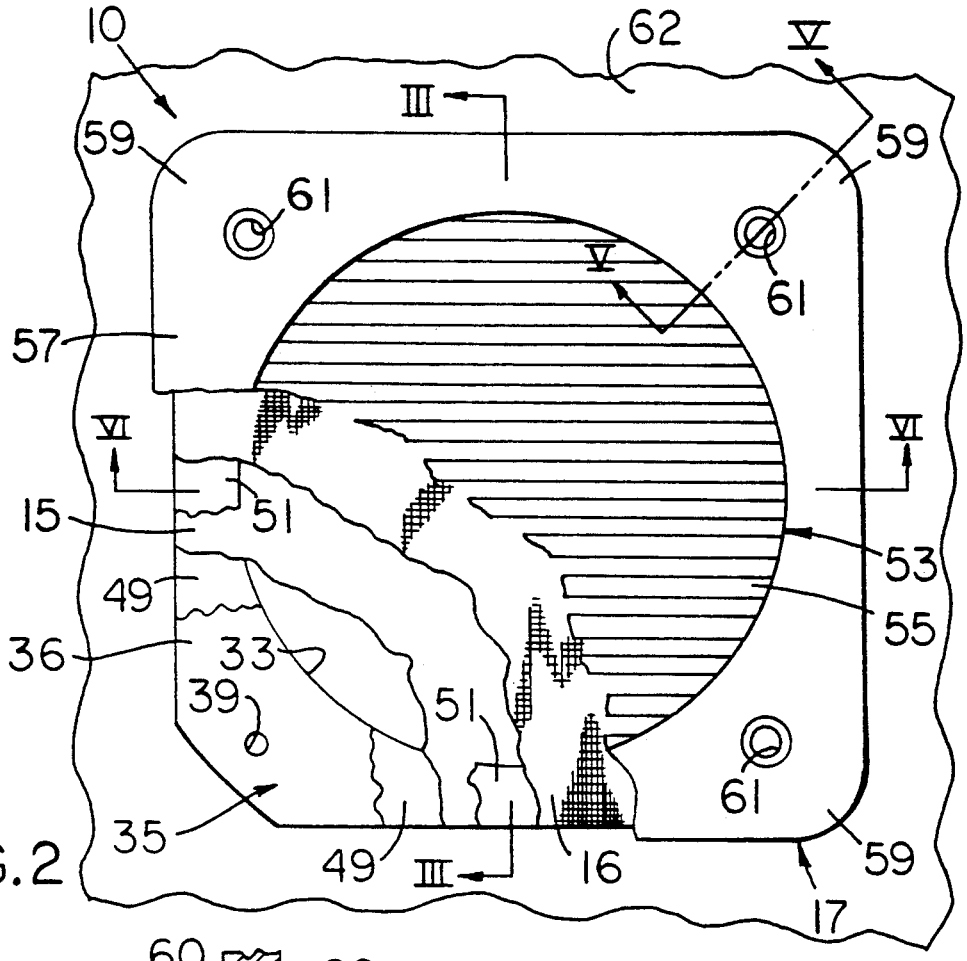
FIG. 2 is a partially broken top view of the FIG. 1 marine horn assembly installed in the hull of a watercraft.
Figure 5:
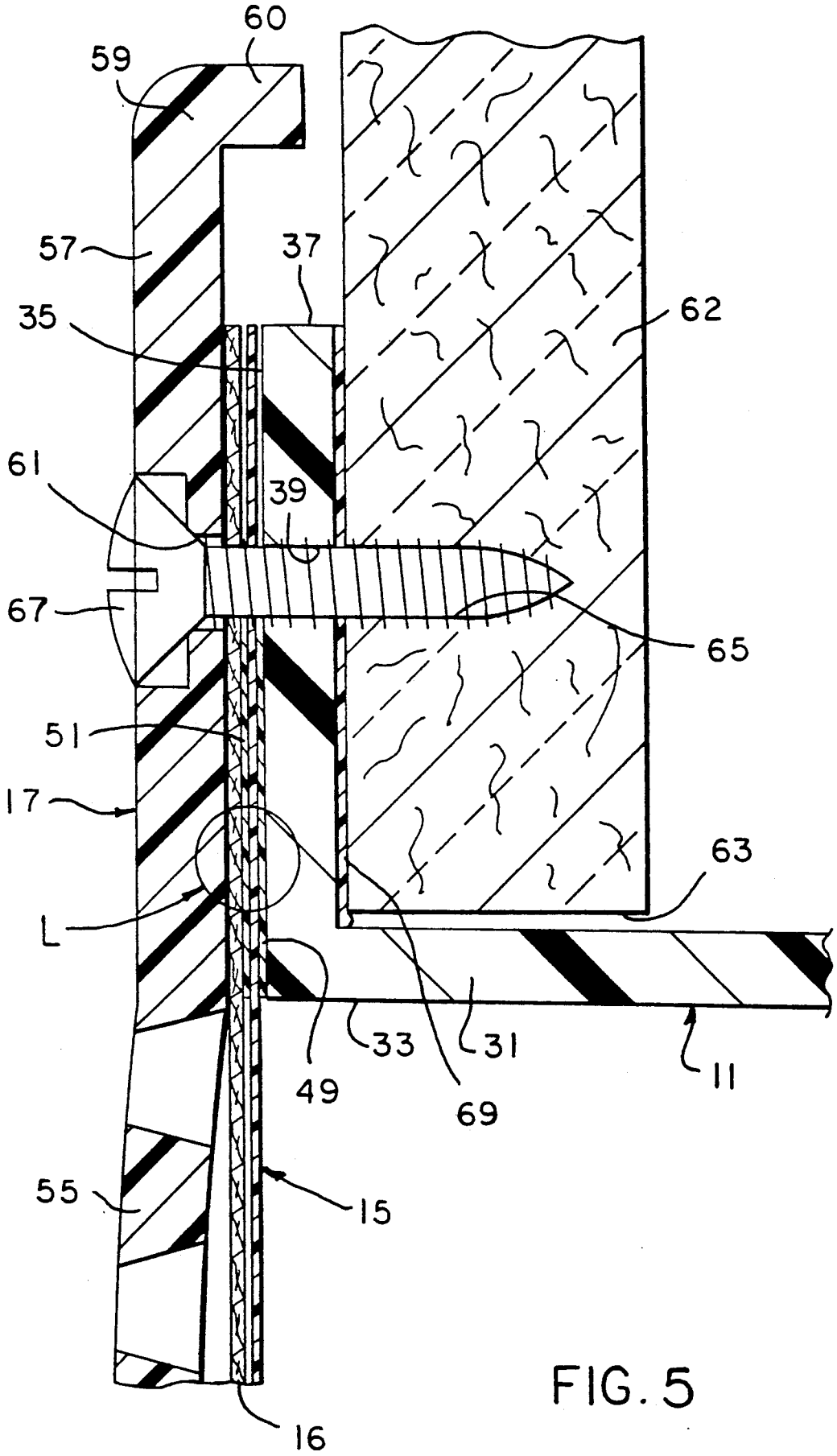
FIG. 5 is an enlarged sectional view taken along the lines V—V of FIG. 2.

Referring to FIGS. 1, 2 and 5, a marine horn assembly 10 includes a rigid, generally cup-shaped housing 11 containing a low silhouette marine horn 13, which horn is enclosed therein protectively against water leakage thereinto by a waterproof but substantially acoustically transparent cover which closes the open end of the housing and comprises a thin sheetlike membrane 15, a flexible perforate screen 16, and a rigid perforate grill 17.

Figure 3:
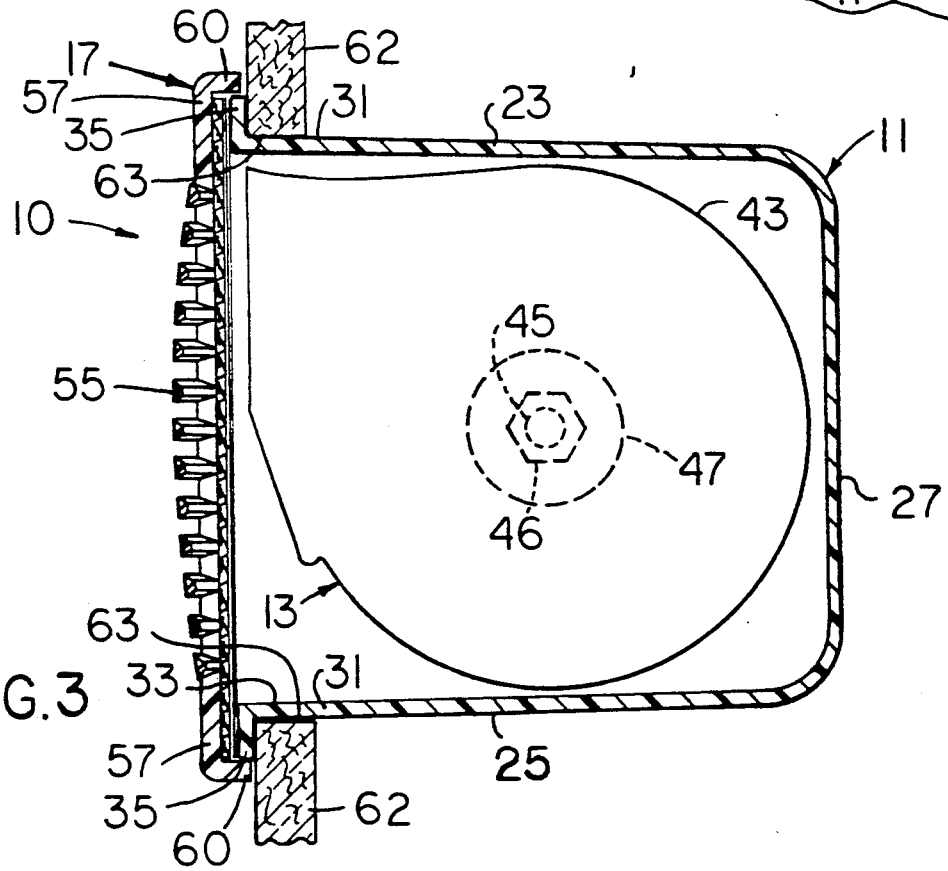
FIG. 3 a sectional view taken along the line III—III of FIG. 2.
Figure 4:
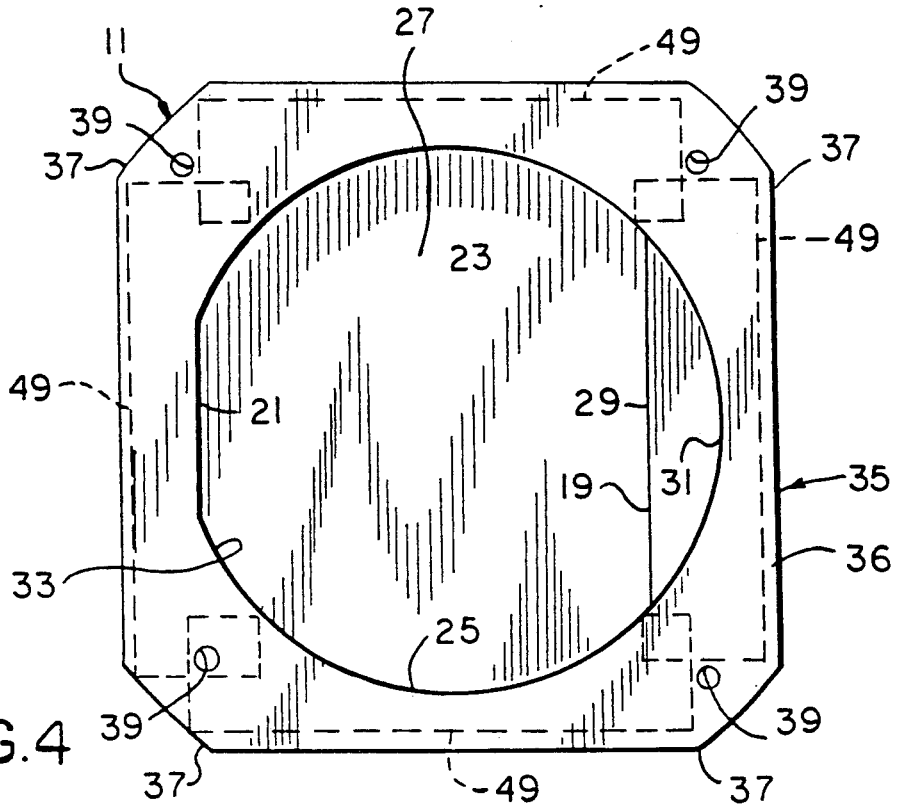
FIG. 4 is a top view of the housing of the FIG. 1 marine horn assembly.
Figure 6:
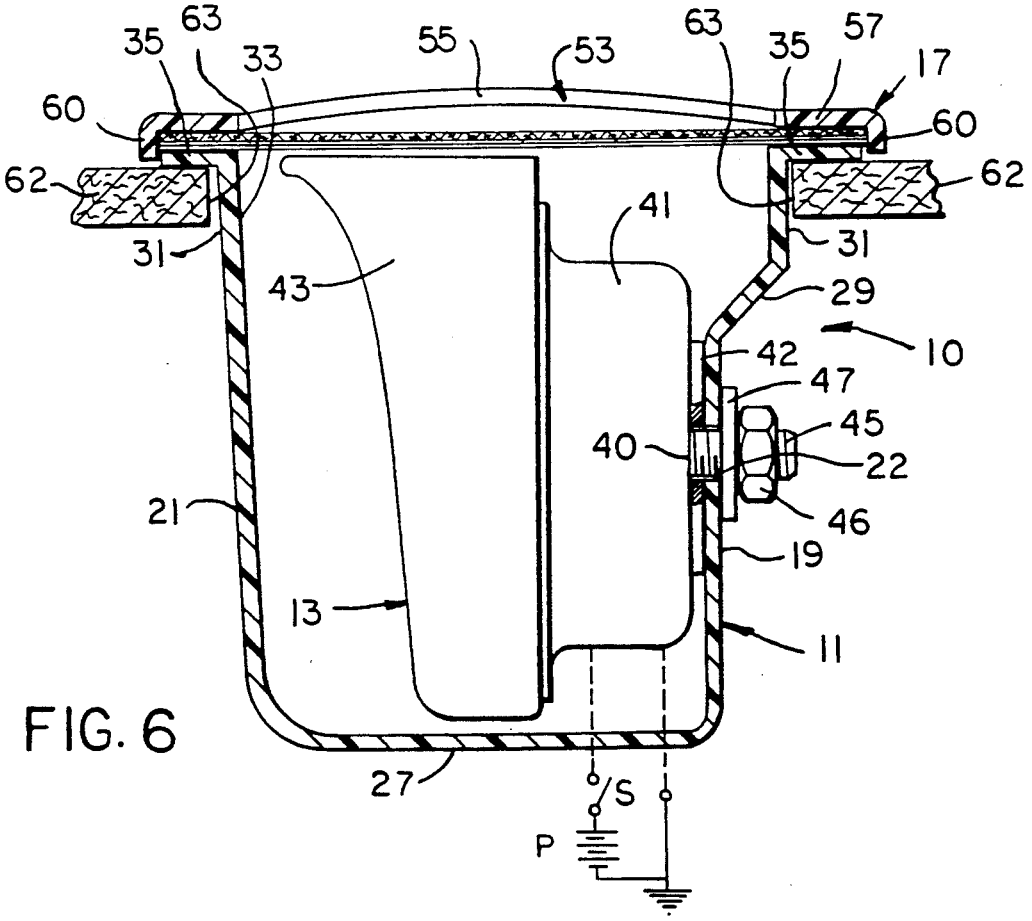
FIG. 6 is a sectional view taken along the lines VI—VI of FIG. 2.

More specifically, and referring to FIGS. 1, 3, 4 and 7, the housing 11 includes a substantially flat bottom wall 27 having four side walls 19, 21, 23 and 25 upstanding generally perpendicularly from the peripheral portion of the bottom wall 27. The side walls 19 and 21 are substantially flat and face each other across the bottom wall 27. The side walls 23 and 25 also face each other across the bottom wall 27, and have a curved contour defined by a circle centered approximately at the center of the bottom wall 27. The curved side walls 23 and 25 are joined at lateral edges thereof to the flat side walls 19 and 21 to form the cup-shaped housing 11. The flat housing side wall 19 has a bolt hole 22 formed therethrough approximately at its center. The top edge portions of the side walls 19, 21, 23 and 25 form a top rim portion 31 of the housing 11. The housing 11 has an open end wherein the rim portion 31 defines thereinside and surrounds an opening 33 into the interior of the housing 11. The flat side wall. 19 extends upwardly from the bottom wall 27 to a step 29 which extends in a direction away from the flat wall 21 and the bottom wall 27. Thus, the top edge portion of the side wall 19 is laterally offset from the lower portion of the wall, as shown in FIG. 6. The top edge portion of the wall 19 is curved so as to be contiguous and concentric with the curved side walls 23 and 25 (FIG. 4). Accordingly, the opening 33 defined by the rim portion 31 of the housing 11 has a primarily circular shape, except for that portion of the rim portion 31 which is formed by the flat side wall 21 as shown in FIG. 4.

The housing 11 includes a flange 35 which extends away from the top rim portion 31 in a direction opposite the opening 33 defined inside the rim portion 31. The flange 35 has a basically planar structure and extends substantially perpendicular to the side walls 19, 21, 23 and 25, and substantially parallel to the bottom wall 27. The flange 35 has a flat top surface 36 facing away from the bottom wall 27. The flange 35 extends generally symmetrically about the opening 33, and has an outer peripheral edge which has a substantially square shape except for smoothly rounded off corners 37. The flange 35 has four circular holes 39 formed therethrough and located approximately midway between the housing opening 33 and the respective rounded corners 37.

The housing 11 is preferably made, in this embodiment, from polystrene.

Referring now to FIGS. 3 and 6, the low silhouette horn 13 includes a base 42 which supports a body 41 on which is mounted a trumpet 43. The horn 13 is arranged in the housing 11 such that the open end of the trumpet 43 faces the housing opening 33. The step 29 in the side wall 19 of the housing 11 provides an adequate expansion of the rim portion 31 to accommodate the flared open end of the trumpet 43. The base 42 of the horn 13 has a bolt 45 projecting outward therefrom through a bolt hole 40. The bolt 45 is inserted through the bolt hole 22 in the side wall 19 to secure the horn 13 to the side wall 19. A flat washer 47 is preferably applied to the bolt 45 on the outside of the housing 11. A nut 46 is threadably engaged with the bolt 45 and tightened against the washer 47 to install the horn 13 in the housing 11. The horn 13 may be conventional, such as Model HYF-372 made by ITC, Incorporated located at Zeeland, Mich.

The membrane 15 is fixed in a watersealed manner to the flange 35 and closes the opening 33 in the open end of the housing 11 to prevent entry of water thereinto and thereby protect the horn 13 therein from contact by water.

In the embodiment shown in FIGS. 2, 4 and 5, the membrane 15 is fixed in the mentioned watersealed manner by strips of waterproof, double faced adhesive tape 49 adhered to the top surface 36 of the flange 35. The strips of tape 49 are generally rectangular and are positioned so as to extend along the flange 35 between respective pairs of adjacent holes 39 and generally parallel to the substantially square outer peripheral edge of the flange 35. The strips 49 are wide enough to cover a substantial portion of the flange 35, and overlap each other between the flange holes 39 and the housing opening 33, as shown in FIG. 4. Thus, the double faced adhesive strips 49 form a substantially continuous adhesive ring surrounding the housing opening 33 on the flange 35. As also shown in FIG. 4, the adhesive strips 49 may cover part or all of the flange holes 39. The waterproof double faced adhesive tape is commercially available from, for example, The 3M Company, located in Minneapolis, Minn.

Referring to FIGS. 2 and 5, the thin, sheetlike membrane is flexible and waterproof. The membrane 15 preferably is of a heat-shrinkable film. A suitable film is produced, for example, by The 3M Company located at Minneapolis, Minn., as winterizing covers for windows in dwellings. The membrane 15 is stable in ultraviolet light (UV stable) and, in this embodiment, has a thickness of approximately ¾ mil (0.00075 inches). The membrane 15 adheres to a face of the adhesive strips 49 opposite the flange 35 so as to over lie the flange 35 and seal the opening 33 against water entry into the housing 11.

To protect the watersealing membrane 15 against breakage, the perforate screen 16 loosely overlies the membrane 15 and is fixedly located at its periphery with respect to the membrane 15 and housing 11. In the embodiment shown in FIG. 2, the peripheral fixing is by further strips of waterproof, double faced adhesive 51 adhered to the outer surface of the membrane 15 to overlie the strips 49 and flange 35. The adhesive strips 51 are preferably identical to the adhesive strips 49. Accordingly, the discussion of the waterproof, double faced adhesive strips 49 above suffices as to the strips 51 also. The strips 51 form a second substantially continuous adhesive ring which surrounds the central portion of the membrane 15 which closes the housing opening 33.

Referring to FIGS. 2 and 5, the protective flexible perforate screen is here of woven mesh. The peripheral portion of the mesh screen 16 here fixedly adheres to the face of the adhesive strips 51. The central portion of the screen 16 is not fixed to but rather loosely opposes the central portion of the membrane 15 over the opening 33 of the housing 11. The screen 16 is constructed, in this embodiment, from a filament nylon which is jacketed with vinyl and woven to form the mesh fabric screen 16. The weave, in this embodiment, defines generally rectangular openings or pores in the screen 16. The pores have dimensions of roughly 1 mm by roughly ⅓ mm, and the pore centers are spaced by approximately 1 ¼ mm, so that the weave pattern is repeated approximately every 2 ½ mm. The screen 16 is UV stable, and has a thickness between approximately ½ mm and 1 mm. It should be noted that the mesh screen 16 is, in this embodiment, made from a material which is substantially similar to that commonly used as webbing in ordinary folding lawn furniture. Such a mesh fabric is commercially available under the brand name Textilene from Janco International, Incorporated, located in Haverhill, Mass.

The grill 17 (FIGS. 1–3 and 5) protects the membrane 15 and screen 16, provides visual appeal, and overlies the mesh screen 16. The grill 17 includes a substantially planar peripheral portion 57 surrounding a circular, central, openwork portion 53. In this embodiment, the grill 17 is preferably made of a suitable plastic, such as polystyrene or ABS, but other materials such as, for example, stainless steel may be used. The peripheral portion 57 of the grill 17 defines an outer peripheral edge which is generally square with rounded corners 59 and which square is slightly larger than that defined by the peripheral edge of the housing flange 35. The grill 17 has four countersunk holes 61 formed through the peripheral portion 57 and located approximately midway between the circular central openwork portion 53 and the respective rounded corners 59 so as to register with the holes 39 in the housing flange 35. A peripheral lip 60 extends generally perpendicularly from the outer peripheral edge of the peripheral portion 57 a distance approximately equal to the thickness of the flange 35 and closely overlaps most but not all of the thickness of the flange 35.

The central openwork portion 53 of the grill 17 here comprises a plurality of side-by-side, substantially rigid, equally spaced, protective cross bars 55. The cross bars 55 extend in generally parallel planes. The cross bars 55 are bowed outwardly away from the mesh screen 16 as they extend in their longitudinal direction, and their transverse cross sections are similarly bowed in their transverse direction, such that the cross bars 55 define a semi-spherical, shallow dome shape which intersects the plane of the peripheral portion 57 along the edge of the circular openwork portion 53.

ASSEMBLY

The assembly of the marine horn assembly 10 for installation in the hull of a watercraft will now be described.

With the horn 13 mounted in the housing 11 and the double faced adhesive strips 49 adhered to the housing flange 35 as described above, a piece of the above-described membrane material, which is at least large enough to completely cover the housing flange 35 and housing opening 33, is pressed down onto the strips 49 for adhesion thereto and so as to completely cover the flange 35 and the opening 33. With the membrane material 15 adhered to the flange 35 by the strips 49, hot air from a heat gun or the like (e.g. conventional pistol grip hair dryer) is applied to the heat-shrinkable membrane material to shrink it for a snugly tensioned fit across the opening 33.

The second set of double faced adhesive strips 51 is then applied to the membrane 15 so as to be in substantial overlying alignment with the strips 49. A piece of mesh screen material 16, at least large enough to completely cover the flange 35 and the opening 33, is then placed on the strips 51 and pressed down for adhesion thereto. Edges of the membrane material 15 and the screen material 16 which extend beyond the outer peripheral edge of the housing flange 35 may then be trimmed away using a suitable cutting tool.

The grill 17 is applied over the screen 16 so that the rounded grill corners 59 register with the rounded flange corners 37. In such position, the countersunk grill holes 61 are coaxially aligned with the flange holes 39. Mounting screws 67, which pass snugly but freely through the grill holes 61, are driven through a laminate (see FIG. 5) formed by the screen 16, adhesive strips 51, membrane 15 and adhesive strips 49, into the flange holes 39. The diameter of the flange holes 39 is approximately equal to the root diameter of the screws 67 and somewhat smaller than the diameter of the countersunk grill holes 61. Accordingly, the screws 67, which pass freely through the grill holes 61, are actually self-threaded through the flange holes 39, and thus the grill 17 is held in position on the housing to protect the membrane 15 and screen 16. The horn assembly 10 may ship in one piece, being held together with the screws 67 in place as shown in FIG. 1.

INSTALLATION

The installation of the marine horn assembly 10 in the hull of a watercraft will now be described with reference to FIGS. 1 and 5.

Preferably, a circular opening 63 having a diameter slightly larger than the diameter of the circle which defines the curved walls 23 and 25 of the housing is bored in the hull 62.

The housing 11 is then inserted into the opening 63 in the hull 62 until the housing flange 35 is seated on that portion of the hull 62 immediately surrounding the hull opening 63. Preferably, a suitable marine sealant material (69 in FIG. 5) is circumferentially continuously interposed between the hull 62 and the housing flange 35 to prevent water leakage through the hull opening 63 into the hull 62. If desired, pilot holes 65 may be drilled in the hull 62 for the screws 67. Often the material of the hull permits driving of the screws 67 thereinto without need for pilot holes. In any event, the screws 67 are driven into the hull to fix and seal the horn assembly 10 in the hull 62 at hull opening 63. Referring to FIGS. 3, 5 and 6, the installed marine horn assembly 10 projects from the surface of the hull 62 by an amount approximately equal to the sum of the thicknesses of the grill 17, the flange 35, and the laminate L. More specifically, the laminate L is compressed between the peripheral portion 57 of the grill 17 and the flange 35, using the screws 67, to form a watertight seal against water entry into the housing opening 33. The grill lip 60 is spaced from the hull 62 so that the lip 60 does not interfere with water sealing between the hull 62 and the housing flange 35, or the compression of the laminate L between the peripheral portion 57 of the grill 17 and the flange 35. The grill lip 60 loosely surrounds the outer peripheral edge of the housing flange 35 and laminate L to provide a finished appearance.

As diagrammatically shown in FIG. 6, the body 41 of the horn 13 is connected through the housing 11 to an electrical power source P via a switch S.

Figure 7:
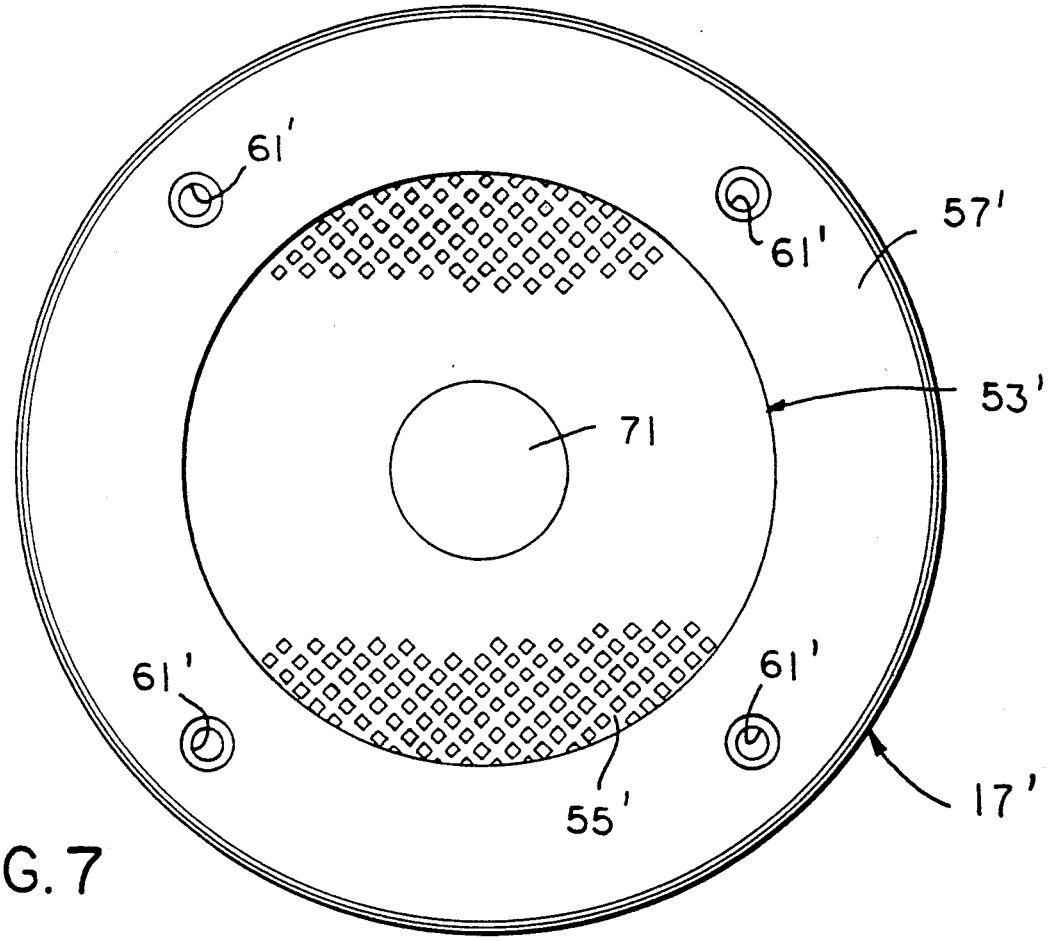
FIG. 7 is a top view of an alternate grill for the FIG. 1 marine horn assembly.

FIG. 7 discloses an alternate grill 17′ which may be used in the marine horn assembly 10. The alternate grill 17′ includes an annular peripheral portion 57′ surrounding a circular, central, perforate portion 53′ comprising a web of cross bars 55′ and a solid circular central portion 71. The alternate grill 17′ also includes four countersunk holes 61′ arranged in the same pattern as in the grill 17.

Although a particular preferred embodiment of the invention has been described in detail for illustrative purposes, it will be recognized that variations or modifications of the disclosed apparatus, including the rearrangement of parts, lie within the scope of the present invention.

The embodiments of the invention in which an exclusive property of privilege is claimed are defined as follows:

1. A waterproof marine horn assembly for substantially flush mounting on the hull of a watercraft, comprising:

a generally cup-shaped housing including a bottom wall and side wall means upstanding therefrom, said upstanding side wall means having a top edge portion with defines a top rim of said housing, said top rim defining thereinside and surrounding an opening in said housing, said housing opening substantially opposite from said bottom wall, said housing further including a flange substantially radially outwardly extending from said rim, said flange having a substantially flat top surface which faces away from said bottom wall and surrounds said opening;

a horn disposed within said housing between said bottom wall and said top rim, said horn being secured to said housing;

a sheetlike, waterproof membrane, said membrane spanning said housing opening and secured to said top surface of said flange so as to completely cover said housing opening and form a watertight seal with said flange;

a grill fixed to said housing flange, said grill having a substantially planar peripheral portion surrounding a central openwork portion, said peripheral portion also defining an outer peripheral edge of said grill, said peripheral portion having at said outer peripheral edge thereof a peripheral lip which extends generally perpendicular to said peripheral portion, said grill being fixed to said housing flange such that said central openwork portion overlies said housing opening and said peripheral portion overlies said housing flange, said membrane being pressed between said housing flange and at least said peripheral portion of said grill, said grill having means disposed in said openwork portion for substantially preventing objects from passing freely therethrough and thereby for protecting said membrane from damage;

adhesive means for adhesively securing said membrane in a tensioned condition to said housing flange, said adhesive means being interposed between said top surface of said flange and said membrane, said adhesive means forming a substantially continuous watertight adhesive ring on said top surface and surrounding said housing opening;

said bottom wall being substantially flat, said upstanding side wall means including first and second substantially flat side walls and first and second curved side walls, said flat and curved side walls being alternatively disposed around the periphery of said bottom wall such that said flat side walls face each other and said curved side walls face each other, said curved side walls having a curvature defined by a circle centered approximately at the center of said bottom wall, each said curved side walls having lateral edges and being joined at each said lateral edge to a respective said flat side wall, whereby said cup-shaped housing is formed; and one of said first and second flat side walls having a hole formed therethrough at a central location therein, said second flat side wall including a lower flat portion and a top edge portion, said top edge portion being laterally offset from said lower flat portion and curved so as to be concentric with said curved side walls, said second flat side wall further including a stepped portion protruding from said lower flat portion and joining said laterally offset, curved top edge portion to said lower flat portion, said stepped portion extending laterally away from said first flat side wall and upwardly away from said bottom wall.

2. The apparatus according to claim 1, wherein said housing flange is substantially planar and extends generally symmetrically about said housing opening, said housing flange having four circular holes formed therethrough and circumferentially spaced approximately equally around said housing opening, and wherein said grill has four countersunk holes formed therein in said peripheral portion and coaxially aligned with said holes in said housing flange, said countersunk grill holes having a larger diameter than said holes in said flange, said peripheral lip of said grill surrounding an outer peripheral edge of said housing flange.

3. The apparatus according to claim 2, including fastening means disposed in said aligned grill and housing flange holes for fixing said grill to said flange and for fixing said flange to the hull of a watercraft.

4. The apparatus according to claim 3, wherein said waterproof membrane is a heat-shrinkable film having a thickness of approximately ¾ mil.

5. A waterproof marine horn assembly, comprising:

housing means for supporting a marine horn thereinside, said housing means having an opening at one end thereof surrounded by a flange portion having a substantially flat surface;

a thin, substantially acoustically transparent, waterproof membrane overlying said flange portion and said opening;

first adhesive means interposed between said flat surface and said membrane for sealingly bonding said membrane to said flange portion;

a perforate screen overlying said membrane, said first adhesive means, said flange portion and said opening;

second adhesive means interposed between said membrane and said screen for sealingly bonding said screen to said membrane, said second adhesive means being substantially in overlying alignment with said first adhesive means;

a protective grill overlying said screen, said second adhesive means, said membrane, said first adhesive means, said flange portion and said opening; and means for securing said grill to said flange portion.

6. The apparatus according to claim 5, wherein said securing means includes means for urging said grill toward said flange portion and for compressing said overlapped screen, second adhesive means, membrane and first adhesive means between said flange portion and said grill.

7. The apparatus according to claim 6, wherein said urging means includes a plurality of holes formed in said flange portion and a plurality of holes formed in said grill, said grill overlying said flange portion such that said holes in said grill are coaxially aligned with said holes in said flange portion, and elongate fasteners extending through said aligned holes in said grill and said flange portion and penetrating said overlapped screen and membrane.

8. The apparatus according to claim 7, wherein said holes in said grill are larger than said holes in said flange portion, said elongate fasteners passing snugly but freely through said grill holes and being snugly engaged in said flange portion holes.

9. The apparatus according to claim 8, wherein said elongate fasteners penetrate one of said first and second adhesive means.

10. The apparatus according to claim 9, wherein said screen is made from a porous, woven mesh fabric, wherein said membrane is made from a heat-shrinkable film, and wherein said first and second adhesive means include double faced adhesive tape.

11. A waterproof marine horn assembly for substantially flush mounting on the hull of a watercraft, comprising:

generally cup-shaped housing including a bottom wall and side wall means upstanding therefrom, said upstanding side wall means having a top edge portion which defines a top rim of said housing, said top rim defining thereinside and surrounding an opening in said housing, said housing opening substantially opposite from said bottom wall, said housing further including a flange substantially radially outwardly extending from said rim, said flange having a substantially flat top surface which faces away from said bottom wall and surrounds said opening;

a horn disposed within said housing between said bottom wall and said top rim, said horn being secured to said housing;

a sheetlike, waterproof membrane, said membrane spanning said housing opening and secured to said top surface of said flange so as to completely cover said housing opening and form a watertight seal with said flange;

said bottom wall being substantially flat, said upstanding side wall means including first and second substantially flat side walls and first and second curved side walls, said flat and curved side walls being alternatively disposed around the periphery of said bottom wall such that said flat side walls face each other and said curved side walls face each other, said curved side walls having a curvature defined by a circle centered approximately at the center of said bottom wall, each said curved side wall having lateral edges and being joined at each said lateral edge to a respective said flat side wall, whereby said cup-shaped housing is formed; and one of said first and second flat side walls having a hole formed therethrough at a central location therein, said second flat side wall including a lower flat portion and a top edge portion, said top edge portion being laterally offset from said lower flat portion and curved so as to be concentric with said curved side wall, said second flat side wall further including a stepped portion protruding from said lower flat portion and joining said laterally offset, curved top edge portion to said lower flat portion, said stepped portion extending laterally away from said first flat side wall and upwardly away from said bottom wall.

* * * * *

UNITED STATES PATENT AND TRADEMARK OFFICE

CERTIFICATE OF CORRECTION

PATENT NO. : 5 099 220

DATED : March 24, 1992

INVENTOR(S) : Richard J. CAMAROTA

It is certified that error appears in the above-identified patent and that said Letters Patent is hereby corrected as shown below:

Column 6, line 55; change "with" to ---which---.

Signed and Sealed this

Seventh Day of September, 1993

Bruce Lehman

*Attest:*

BRUCE LEHMAN

*Attesting Officer*

*Commissioner of Patents and Trademarks*